United States Patent [19]

Carlisle

[11] Patent Number: 4,565,023

[45] Date of Patent: Jan. 21, 1986

[54] INDICIA DISPLAY MEANS

[76] Inventor: G. Ross Carlisle, 391 Main St., Newfield, N.Y. 14867

[21] Appl. No.: 529,527

[22] Filed: Sep. 6, 1983

[51] Int. Cl.[4] ..... G09F 7/00

[52] U.S. Cl. ..... 40/486; 40/5; 40/109; 40/158 R

[58] Field of Search ..... 40/5, 109, 488, 486; 273/161, 157

[56] References Cited

U.S. PATENT DOCUMENTS

| | | | |
|---|---|---|---|
| 381,425 | 4/1888 | Rosenwasser | 40/109 |
| 704,208 | 7/1902 | Post | 40/109 |
| 1,219,178 | 3/1917 | Sellers | 40/122 |
| 1,366,968 | 2/1921 | Starrett | 40/152 |
| 2,234,341 | 3/1941 | Goldner | 273/161 |
| 2,515,820 | 7/1950 | Clark | 40/158 |
| 3,546,801 | 12/1970 | Kolody | 40/109 |
| 3,953,933 | 5/1976 | Goldstein | 40/152 |

FOREIGN PATENT DOCUMENTS

| | | | |
|---|---|---|---|
| 481303 | 8/1921 | Fed. Rep. of Germany | 273/157 R |

*Primary Examiner*—Gene Mancene
*Assistant Examiner*—Wenceslao J. Contreras
*Attorney, Agent, or Firm*—Barnard & Brown

[57] ABSTRACT

Indicia display means comprising an indicia-bearing member having one or more sets of visible indicia located thereon in predetermined locations, and a mask member arranged to overlay the indicia-bearing member, the mask member having perforations or openings at predetermined locations to expose selected ones of said visible indicia. The mask member may be provided with a mirror image set of said indicia on the reverse side of the mask member to assist in locating the site of said openings or perforations in the mask member. The location of the indicia, the color, and/or the color of the background and/or the color of the mask areas may be used to convey information, in addition to the values assigned to the indicia themselves.

2 Claims, 9 Drawing Figures

INDICIA DISPLAY MEANS

FIELD OF THE INVENTION

This invention relates to indicia display means, and more particularly, to improved indicia display means for displaying identification symbols, characters or the like, associated with utility circuits, outlets, switches, and the like.

BACKGROUND OF THE INVENTION

It is very desirable to provide identification of electrical branch circuits at utility outlets, circuit controlling and indicating means, such as switches, push buttons, fuses, indicator lamps, etc. In many cases paper or plastic labels are used, with the identifying indicia recorded thereon by handwriting, printing or embossing. The labels may be fixed in place by self-carried adhesive backing, by an overlay of transparent adhesive tape or the like, and may or may not have a protective transparent overlay. Still other identification means include slots or openings in the cover plates usually provided for such outlets, in which paper strips may be placed, with hand written or printed indicia thereon.

The foregoing prior art arrangements have a number of disadvantages. The use of unprotected paper or plastic labels will result in eventual damange and/or obliteration of the label. Preparation of legible labels calls for care in their lettering or embossing, and such care is not usually forthcoming. The commonly used Dymo style labels will lose their lettering if subjected to even moderate heat.

OBJECT OF THE INVENTION

Accordingly, a principal object of my invention is to provide a new and improved indicia display means for identifying indicia associated with utility outlets and the like.

Another object of my invention is to provide an improved indicia display means which does not require the preparation of handwritten, printed or embossed labels for each occasion of use.

A further object of my invention is to provide utility outlet identification means in which previously prepared indicia are selectively displayed by simple manual operations not involving writing, printing or embossing.

Yet another object of my invention is to provide display means arranged so that only selected indicia can be displayed in various display areas, thereby greatly reducing the possibility of incorrect data being displayed.

Still a further object of my invention is to provide improved display means in which colored areas or characters or symbols may be selectively displayed to impart more information than would otherwise be available.

Still another object of my invention is to provide improved display means which is economical to manufacture, simple to use, sturdy and durable, and less prone to errors in use.

SUMMARY OF THE INVENTION

In accordance with the present invention, there is provided an indicia-bearing member having thereon one or more areas wherein groups or visible indicia are provided, as by printing. Each symbol or character is located at a predetermined location on the indicia-bearing member. A mask member is also provided, arranged to be superimposed on the indicia-bearing member. Selectively located openings are made in the mask member, as by punching holes in the mask member, or by removing pre-scored areas. With the mask member overlying the indicia bearing member, the opening in the mask member will render the selected areas and/or symbols on the indicia-bearing member visible.

The assembled mask member and indicia-bearing member may be mounted in a suitable card carrying element. Another arrangement provides for mounting the elements beneath a cover plate of the type well known for utility outlets which cover plate may be transparent or opaque. To aid in the selection of punching locations, the rear side of the mask member may be imprinted with a mirror image configuration of the code areas provided on the indicia-bearing member.

BRIEF DESCRIPTION OF THE DRAWINGS

The foregoing objects and other features and advantages of my invention will become more fully understood from the following detailed description when considered with the accompanying drawings, in which.

Similar reference characters refer to similar parts in each of the several views.

DETAILED DESCRIPTION OF THE INVENTION

Figure 1A:
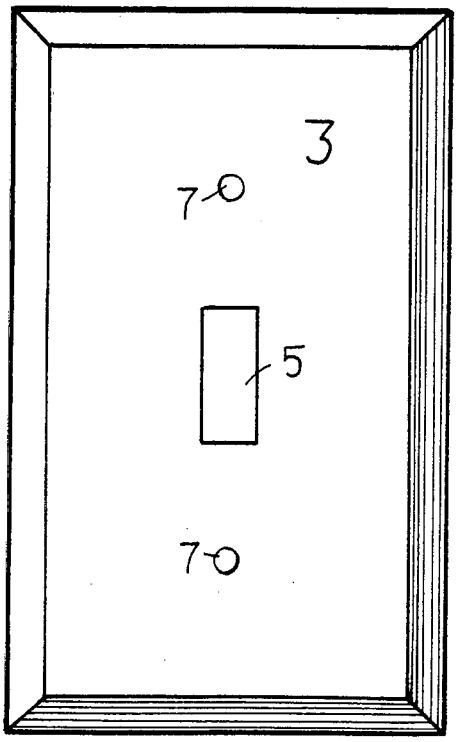
FIG. 1A is a top plan view of a cover plate as would be used with an electrical toggle switch of well know design.

Referring now to FIGS. 1A through 1E of the drawings, there is shown a first preferred embodiment of my invention, arranged to be used with a toggle switch of well-known design, usually employed as a wall mounted switch for residential and commercial electrical distribution systems. The switch, its mounting box, etc., are not shown, for the sake of clarity, since their actual construction is not germane to my invention. The switch is usually protected by a cover plate having a vertically disposed rectangular opening through which the switch operating handle protrudes. FIG. 1A shows a coverplate (3) to be used with such a switch. Plate (3) has the usual beveled edges on all four sides, and the rectangular opening (5) is for the switch handle. The plate (3) is attached to the switch structure by small machine screws which pass through the screw holes (7). The plate (3) is preferably transparent, but may be opaque in situations where a less-obvious indicia is desirable, such as in homes.

Figure 1B:
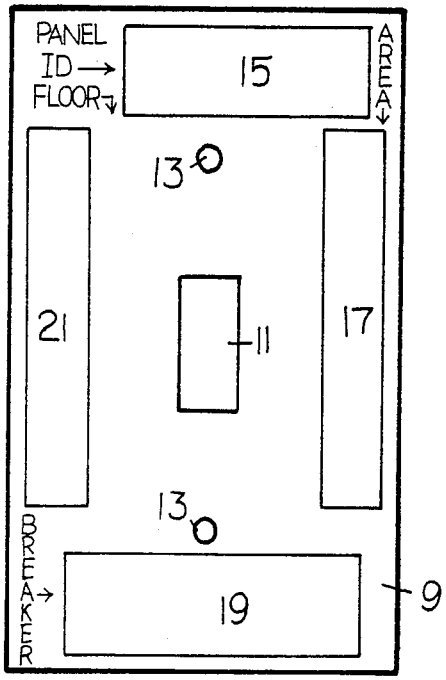
FIG. 1B is a top plan view of a mask member in accordance with a preferred embodiment of my invention, to be used with the cover plate of FIG. 1A.

FIG. 1B shows a mask member (9) in accordance with one preferred form of my invention, comprising a rectangular sheet of material such as paper, plastic, metal or the like, of a thickness to permit relatively easy perforation by suitable punching or perforating means, such as, for example, a manually operated paper punch which punches circular holes. The mask surface may be uncolored, or colored to match a room's color scheme, or to convey information by its color. The mask (9) is dimensioned so that it will fit in the usual recess found in the rear of the coverplates. Mask (9) has openings (11) and (13) therein, prepared at the time of manufacture, and corresponding to openings (5) and (7) in plate (3). One or more data areas are delineated on the front surface of mask member (9). For example, four rectangular areas (15), (17), (19) and (21) are disposed around the edges of mask member (9), and are premarked, as by printing, "Panel ID", Area", "Breaker", and "Floor", respectively. The delineated areas may be uncolored, colored the same as their background, or provided with a preselected color to provide specific information.

Figure 1C:
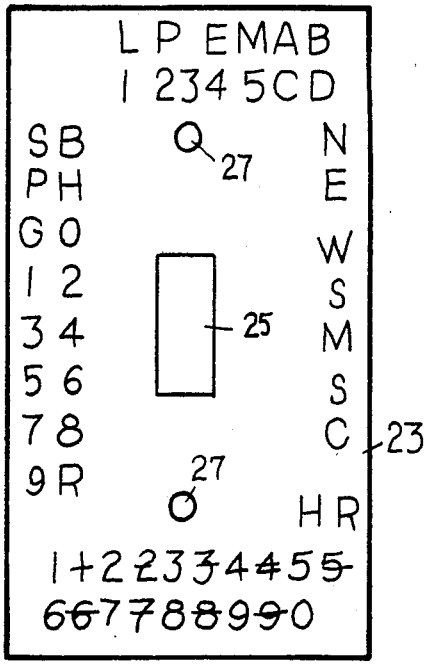
FIG. 1C is a top plan view of an indicia-bearing member in accordance with a preferred embodiment of my invention, to be used with the mask member of FIG. 1B.

Referring now to FIG. 1C of the drawings, there is shown an indicia-bearing member (23), designed and arranged in accordance with a first preferred form of my invention. Member (23), similar to member (9), may be made of paper, plastic, metal, etc., and is selected to have a thickness which provides reasonable durability for handling, but is thin enough to not render the total assembly too thick. Member (23) has preformed openings (25) and (27) therein, to match the corresponding openings in the cover plate (3) and the mask member (9). In one or more predefined areas on the face of member (23), there are groups or sets of indicia which may comprise numbers, letters or symbols, or combinations thereof. Four such sets of indicia are shown on member (23), corresponding to the four areas shown on mask member (9) in FIG. 1B.

It will be readily apparent that by providing appropriately located punched holes or apertures in mask member (9), and overlaying the mask member on the indicia-bearing member (23), specific indicia will be displayed to the viewer of the assembly when the two superimposed members (9) and (23) are disposed beneath the plate (3).

Figure 1D:
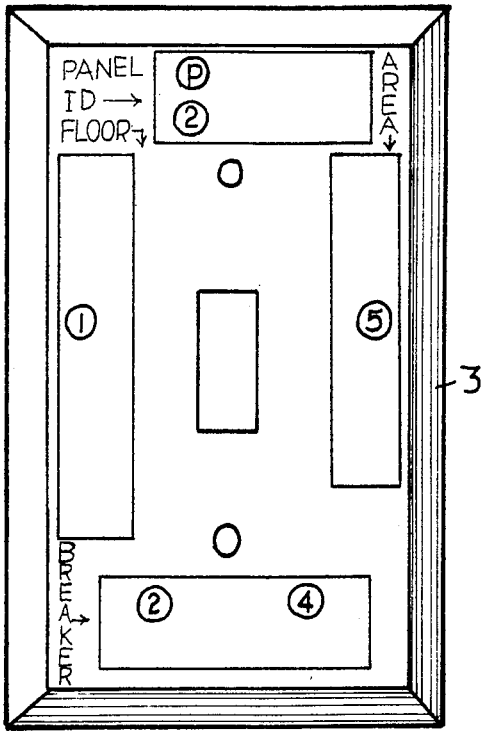
FIG. 1D is a top plan view of the assembly of parts shown in FIGS. 1A, 1B and 1C.

The appearance of the total assembly will be shown, for example, in FIG. 1D. In this example, the panel ID is designated "P2"; the Area is designated "S"; the breaker is designated as "24"; the floor is designated as "1". As previously noted, the colors of the characters and symbols as well as the background may be selected to convey various meanings.

Figure 1E:
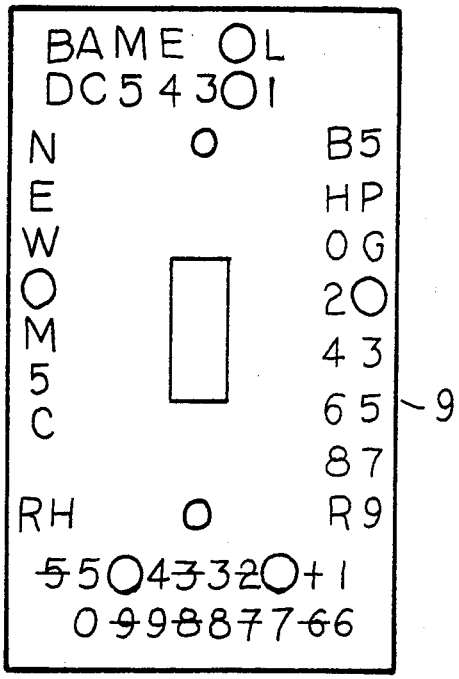
FIG. 1E is a view of the reverse side of element 9, the front view being shown in FIG. 1B

FIG. 1E is a view of the reverse side of the mask member, on which the code sets shown on the front side of the indicia-bearing member (23) FIG. 1C, are located in mirror image positions, as will be manifest from consideration of the two figures. By providing this mirror image arrangement of the code sets, the user will be readily able to determine the location of the perforations which have to be made in the mask member in order to display the desired indicia on the member (23).

Figure 2:
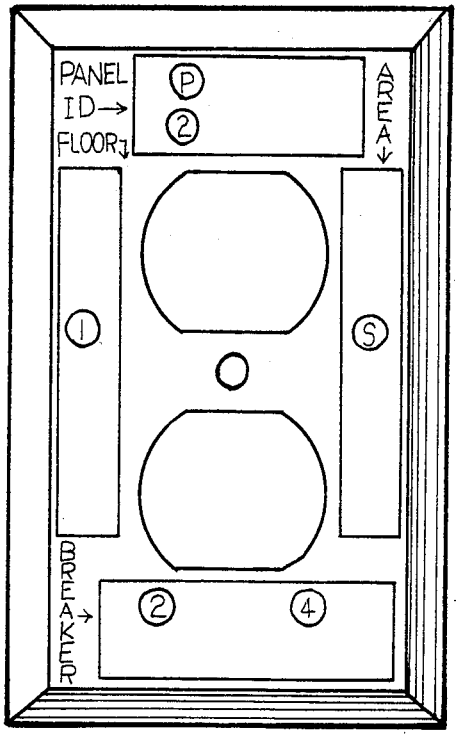
FIG. 2 is a top plan view of another embodiment of my invention, designed to be used with a so-called duplex electrical receptacle, of a type well known in the art.

FIG. 2 shows the use of my invention in connection with an electrical utility outlet of the type usually termed a duplex receptacle. The similarities and the differences between this arrangement and that shown and described for use with a toggle switch will be readily apparent and a detailed description is deemed unnecessary.

Figure 3A:
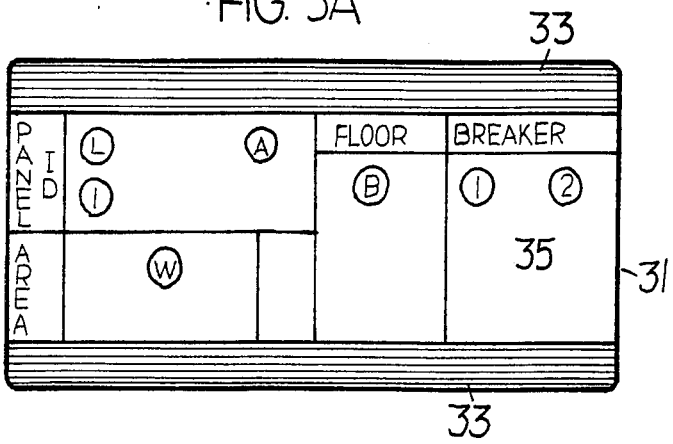
FIG. 3A is a top plan view of another embodiment of my invention, in which the elements of the assembly are retained in a holding member provided with longitudinal extending flanges which retain the assembly in place.
Figure 3B:
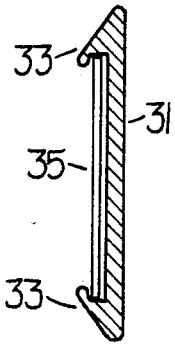
FIG. 3B is a cross sectional view of the embodiment shown in FIG. 3A.

FIG. 3A shows an assembly using a conventional card holder to hold the indicia-bearing member and the mask member. Such an arrangement would be useful in providing information on control panels, breaker panels, etc., where there are expanses of the panel to which the assemblies can be affixed by screws, adhesives and the like. An indicia-bearing member, overlaid by a suitably perforated mask member, is placed in the holder (31), which, as can be seen in the cross sectional view of FIG. 3B, has inturned flanges (33) to retain the display assembly in place. The assembly can also include a transparent member (35) to protect the display assembly from dirt and disfiguration. Extruded moldings which are well known and commercially available may be used to fabricate the holder (31).

Figure 4:
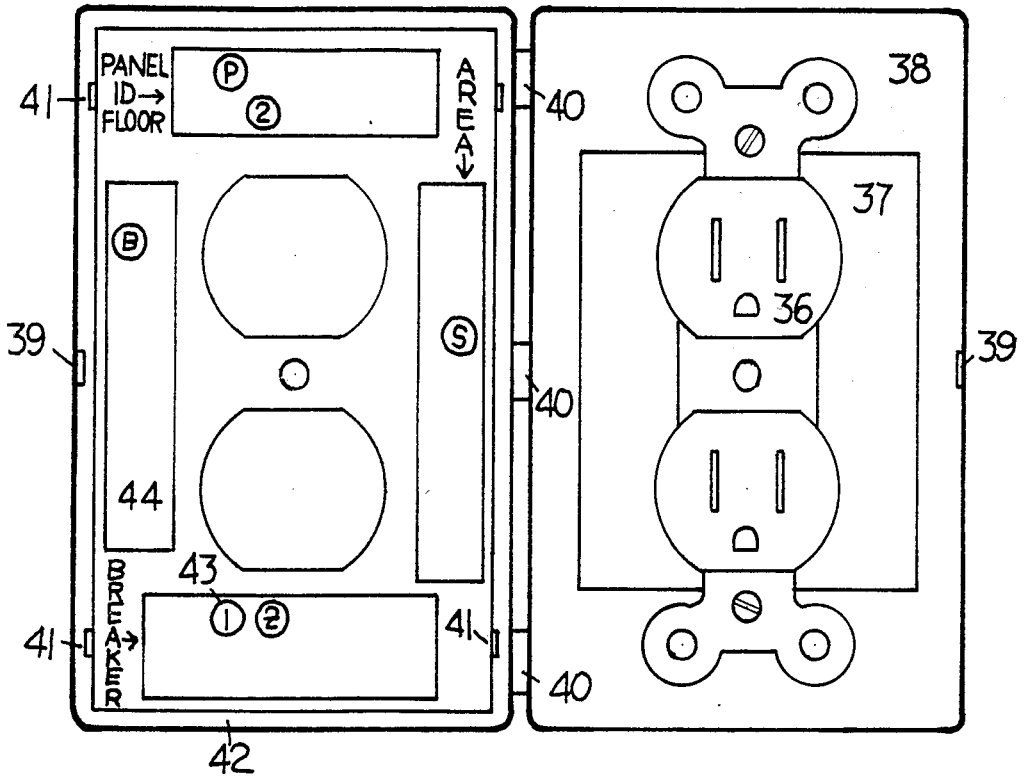
FIG. 4 shows an embodiment of the invention in which the elements are retained in a hinged cover in an outlet plate.

FIG. 4 shows still another embodiment of my invention, especially suitable for applications where the appearance of the indicia upon the plate might be considered inappropriate, such as in formal rooms. In such a case, the indicia bearing member (43) and mask member (44) are mounted within an opaque cover plate (42) by means of clips (41) or the like. The cover plate (42) is hinged (40) to a mounting plate (38) which is, in turn, attached to the wall (37) under the outlet (36) to be labeled. The cover (42) may be swung shut on its hinges (40), hiding the indicia, and be latched shut by a latch (39) or any convenient sort.

From all of the foregoing, it will be apparent that my invention provides new and unique arrangements for displaying relevant information for utility outlets and control devices, with advantages including economy of manufacture, simplicity to install, and much freer from the possibility of error than previous arrangements.

Although I have herein shown and described only a few preferred embodiments of my invention, it will be apparent to those skilled in the art to which the invention appertains, that various other changes and modifications may be made to the subject invention, without departing from the spirit and scope thereof, and therefore it is understood that all modifications, variations and equivalents within the spirit and scope of the subject invention are herein meant to be encompassed in the appended claims.

I claim:

1. Indicia display means for identification of an associated utility circuit or the like comprising: an indicia-bearing member having a plurality of visible indicia thereon, the indicia being capable of identifying a plurality of utility circuits or the like, and a mask member proportioned and arranged to be superimposed on said indicia-bearing member, said mask member having areas which, when selectively perforated by a user, expose one or more of said indicia on the indicia-bearing member to view, said mask member having visible indicia on the reverse side thereof, corresponding to the indicia carried by said indicia-bearing member but located in mirror-image relation with respect to the location of the indicia on said indicia-bearing member, whereby the associated utility circuit or the like is selectively displayed from the plurality of possible utility circuits represented by the indicia.

2. Indicia display means for identification of utility circuits or the like associated with utility outlet devices comprising, in combination, a cover plate for the utility outlet, said cover plate having at least a central portion which is transparent, indicia bearing means having a plurality of visible indicia thereon, the indicia being capable of identifying a plurality of utility circuits or the like, the indicia-bearing means adapted to underlie said central portion of said cover plate, a mask member co-extensive with and adapted to overlie said indicia-bearing member, having at least one portion thereof adapted to be selectively perforated by a user to provide an opening superimposed over the indicia on said indicia-bearing member, said mask member having visible indicia on the reverse side thereof, corresponding to the indicia carried by said indicia-bearing member and located in mirror-image relation with respect to the location of the indicia on said indicia-bearing member, said indicia-bearing member and the overlying mask member being disposed behind the transparent portion of said cover plate, whereby the utility circuit or the like associated with the utility outlet device may be identified.

* * * * *